United States Patent [19]

Petrini et al.

[11] Patent Number: 4,777,742

[45] Date of Patent: Oct. 18, 1988

[54] SKI BOOT WITH SPRING ACTION FLEX CONTROL

[75] Inventors: Roland Petrini, Chambéry; Joseph Morell, Annecy-le-Vieux, both of France

[73] Assignee: Salomon, S.A., Annecy, France

[21] Appl. No.: 85,766

[22] Filed: Aug. 17, 1987

Related U.S. Application Data

[63] Continuation of Ser. No. 570,643, Jan. 13, 1984, Pat. No. 4,694,593.

[30] Foreign Application Priority Data

Jan. 14, 1983 [FR] France ..... 83 00796

[51] Int. Cl.[4] ..... A43B 5/04

[52] U.S. Cl. ..... 19/120; 36/121

[58] Field of Search ..... 36/120, 121

[56] References Cited

U.S. PATENT DOCUMENTS

| | | | |
|---|---|---|---|
| 3,728,804 | 4/1973 | Mochizuki | 36/2.5 AL |
| 3,738,025 | 6/1973 | Hanson et al. | 36/2.5 |
| 4,043,059 | 8/1977 | Rothmell | 36/121 |
| 4,095,356 | 6/1978 | Robram et al. | 36/121 |
| 4,258,482 | 3/1981 | Salomon | 36/121 |
| 4,455,768 | 6/1984 | Salomon | 36/121 |
| 4,461,103 | 7/1984 | Annovi | 36/121 |

FOREIGN PATENT DOCUMENTS

| | | | |
|---|---|---|---|
| 339772 | 11/1977 | Austria . | |
| 2100490 | 3/1972 | France . | |
| 2278280 | 2/1976 | France . | |
| 2416661 | 10/1979 | France | 36/121 |
| 2371162 | 6/1981 | France . | |
| 2480575 | 3/1982 | France . | |
| 2495901 | 6/1982 | France . | |
| 2484800 | 8/1982 | France . | |
| 2539278 | 11/1985 | France . | |

*Primary Examiner*—Louis K. Rimrodt

*Attorney, Agent, or Firm*—Sandler & Greenblum

[57] ABSTRACT

A ski boot having a rigid shell bass on which a cuff is journalled to pivot around a transverse axis, and flexion means for affecting the flexional characteristics of the cuff. The flexion means is formed of a spring member positioned between the cuff and the shell base. The spring member is positioned to at least partially extend around the instep of the boot and has no attachment point in the region adjacent to the journal axis.

15 Claims, 4 Drawing Sheets

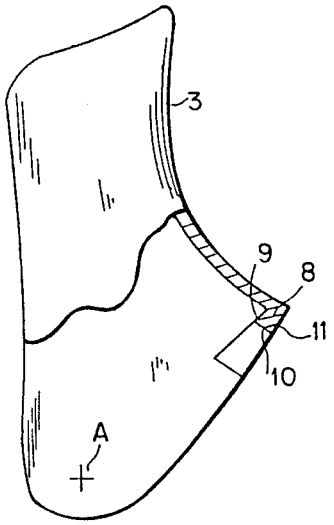
FIG. 5.
FIG. 6.
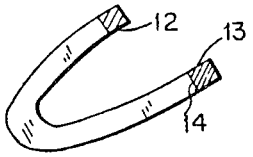
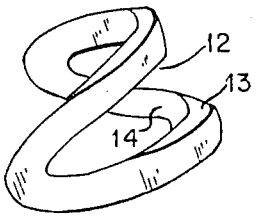
FIG. 7.
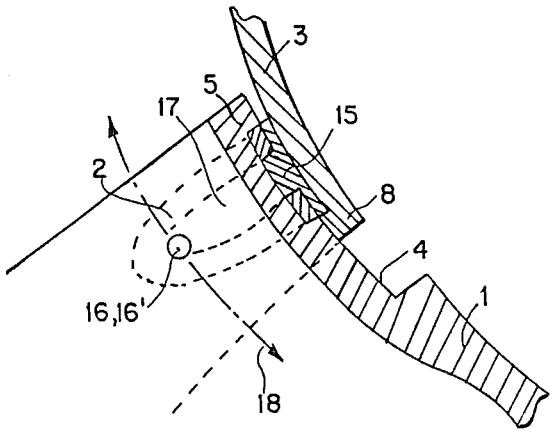
FIG. 8.
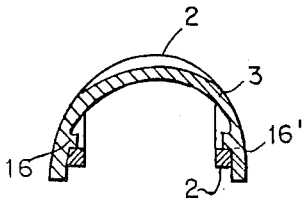
FIG. 9.

SKI BOOT WITH SPRING ACTION FLEX CONTROL

This is a continuation of application Ser. No. 570,643 filed Jan. 13, 1984, now U.S. Pat. No. 4,694,593, granted Sept. 22, 1987.

BACKGROUND OF THE INVENTION

1. Field of the Invention

The invention relates to a ski boot in which the upper portion of the boot surrounding the lower leg of the skier is adapted to flex relative to the vamp portion of the upper surrounding the foot.

2. Description of Pertinent Materials and Background

The present invention relates to ski boots of the rear-entry type, particularly those used in alpine skiing. Such boots are well-known and comprise a rigid shell base mounted on a sole. An upper is provided which is pivotably journalled on the shell base around a generally horizontal axis and comprises a cuff and a rear spoiler. During leg movements the cuff is movable within certain limits around the journal axis, and with a resistance which is proportional to the amplitude of the pivot angle. Flexion of the upper also serves as a shock absorber to absorb sudden forces in the form of brutal and sudden shocks, directed frontwardly or rearwardly relative to the upright position of the skier, as well as adding to the comfort and safety of the skier. This ability of the upper to flex should not, therefore, be arbitrary and unconditional, but rather must be provided in a manner which satisfies certain constraints, as well as varying conditions. Therefore, apparatus have been contemplated which permit modification or adjustment of the degree of flexion. The present invention relates to one such device.

Apparatus known in the prior art, such as those described in French Pat. No. 2,100,490 or French Patent Application No. 2,416,661, comprise a shock absorption apparatus having a single or double action spring which is anchored and extends between a central position situated at an upper position on the front of the cuff and a central point situated towards the front of the foot on the rigid shell base or integral therewith. Besidse the unattractive appearance of such apparatus, such apparatus are very cumbersome and are exposed to being hit in the course of use. Such apparatus can likewise get caught and snag undesirably in the course of use and movement by the skier. There is thus a certain danger in using boots having such systems, and their reliability is reduced because of their random and unpredictable behavior.

In French Pat. No. 2,278,280 an apparatus is proposed which can partially and inherently function to provide results of the type discussed above. However, the apparatus involves removable linkage elements positioned between the rigid shell base and the cuff itself. In the environment of the boot of the present invention which is of the rear-entry type, the apparatus would be secured to rear spoiler rather than the cuff, given the fact that the boot disclosed in the patent is of the front-entry type. In fact, were such an apparatus placed behind the boot, it would serve only as a substitute for a transverse pivot axis, by virtue of its elasticity, of the cuff on the rigid shell base. The solution proposed is thus clearly distinguishable from the present technology.

The two preceding apparatus function only in, or approximately in, a longitudinal vertical plane without involving the important zone which is formed by the flexion fold and the instep. This disadvantage disappears in the solution proposed in French Application Nos. 2,480,575 and 2,484,800.

In the first Application, a flexion band is provided at the lower front portion of the cuff and rests on the rigid shell base. This band is an integral portion of the cuff, or is separate therefrom, and is attached along a transverse journal axis (or immediately adjacent thereto), or fixed at two joints to the rigid shell base. The transmission of force occurs by means of a stop whose position is adjustable. This appealing construction remains relatively complex and breaks the line of the boot, thus detracting from its appearance.

The embodiment proposed in Application 2,484,800 is related to the embodiment disclosed in the preceding Application. This approach is simpler, but adjustment of rigidity is not possible and the apparatus suffers about the same disadvantages. In both cases, the band is attached at its ends and works exclusively in flexion as an embedded beam (cantilever) at the level of, or immediately adjacent to, the journal axis. Furthermore, when the band is formed integrally with the cuff, it is necessarily formed of the same material. Thus, the band has the same mechanical characteristics as those of the cuff, including its elastic characteristics. Where the band is applied separately, its attachment to the shell base and the transmission of the forces between it and the cuff complicates the manufacture and assembly of the boot.

SUMMARY OF THE INVENTION

It is, therefore, an object of the invention to overcome the above disadvantages with respect to a ski boot having a rigid shell base on which a cuff is journalled to pivot around a transverse axis.

According to the invention flexion means in the form of a flexion element are provided for affecting the flexional characteristics of the cuff. The flexion means is a spring member positioned between the cuff and the shell base. The spring member is positioned to at least partially extend around the instep of the boot and has no attachment point in the region adjacent to the journal axis. The ski boot is preferably adapted for use in alpine skiing.

The spring member may be a unitary element distinct from the cuff and/or the shell base, whereby the spring member may be removed and replaced as desired. The spring member is preferably in the form of a dihedral. The dihedral is formed of a ring folded along its diameter so as to provide upper and lower central portions, spaced from the edges of the fold. The central portions are adapted to cooperate with the cuff and the shell base so as to impart desired flexional characteristics to the boot.

More generally, the spring member can be characterized as being formed of two horizontal members connected at their ends whereby flexion of the foot against the cuff forces the horizontal members together. The horizontal members may be provided with curved upper and lower surfaces adapted to contact the cuff and the shell base such that upon frontward flexion of the cuff, the upper and lower surfaces of the horizontal members flatten against the cuff and shell base thereby distributing the force exerted thereon over an increased surface. In turn, the cuff may have a recessed slot adapted to receive one of the horizontal members to at least partially obscure the horizontal member from view.

The shell base and cuff may be configured to either tension or compress the spring member as the cuff is forwardly flexed relative to the shell member.

In one embodiment, where the spring is in tension, the cuff has a lower cusp adapted to overlap an upper cusp of the shell base. The upper and lower cusps of the shell base and cuff, respectively, are normally biased towards one another by the upper and lower central portions of the spring member which tension the spring member as the cuff flexes forwardly.

In an embodiment where the spring is in compression, the shell base may have a ramp adapted to receive a lower cusp of the cuff. The spring member has central portions positioned between the lower cusp or lower edges of the cuff and an upper cusp or upper surface of the shell base.

The spring member may be configured to engageably mate with the cuff and the shell member to minimze risk of it falling out.

In yet another embodiment the cuff has a finger on each side of the shell base, and the spring member is in a folded ring configuration having upper and lower central portions. The boot further has a blocking member adapted to maintain the spring member in a fixed position to function as a cantilever. The spring member is forced within a groove on a ramp on the shell base under pressure exerted by the cuff. Frontward flexion of the cuff relative to the shell base causes the fingers to exert a downward force on the spring member at the fold thereof. The blocking member is positioned between the upper and lower central portions of the spring member, and extends over at least a portion of the upper and lower shoulders.

The spring member may be formed of a material which is the same as, or different from, that of the shell base or cuff, and may be either integral with the boot of separable and interchangeable.

When the spring member is made integral with the cuff it may generally be of a semi-ring configuration and be connected on both sides of the instep to two sides of the cuff in front of the transverse journal axis.

The invention is likewise directed to a method of regulating flexional forces in a ski boot of the type discussed above wherein the resistance to flexion is increased in proportion to the flexional force applied by the leg against the cuff.

BRIEF DESCRIPTION OF THE DRAWINGS

The invention will now be described by way of non-limiting example only, with reference to the annexed drawings in which:

FIGS. 4 and 5 more particularly illustrate in greater detail the portions of the boot which are of interest of the embodiments of FIGS. 2 and 3, i.e., the shell base and the cuff;

FIGS. 6 and 7 illustrate the spring of FIG. 1 in cross section and in perspective, respectively, removed from the boot;

FIGS. 8 and 9 illustrate another embodiment of the invention;

DESCRIPTION OF PREFERRED EMBODIMENTS

The present invention overcomes the disadvantages of the prior art as well as the limitations inherent in prior art apparatus. According to the invention an apparatus is provided for controlling the flexion of the upper which integrates better with the boot, both as to contour and principal, and which may be a distinct element both from the upper and the shell base. This distinctness renders it interchangeable and allows for utilization of materials having different mechanical characteristics adapted to actual needs. This in turn allows for the use of less sophisticated and expensive materials. When this apparatus is positioned between the cuff and the shell base it is positioned as far as possible from the transverse journal axis. As a result, for equal applied energies, the least possible force possible is applied to the element, which is best distributed over the zones of the cuff and the shell base which are concerned. This again permits utilization of less costly and sophisticated materials.

The apparatus according to the invention utilizes a spring member which at least partially surrounds the instep and, in one embodiment, has the general configuration of a ring which is only partially folded around one of its diameters. The partially folded ring is interposed between the rigid shell base and the cuff, and need not be integral with either of them. The spring member has at least one zone of support adapted to abut each of the cuff and the shell base so as to maintain the two spring biased apart. The spring member softens the forward flexional movements of the cuff through elastic deformation and biases the cuff rearwardly relative to the front of the shell base.

Figure 1:
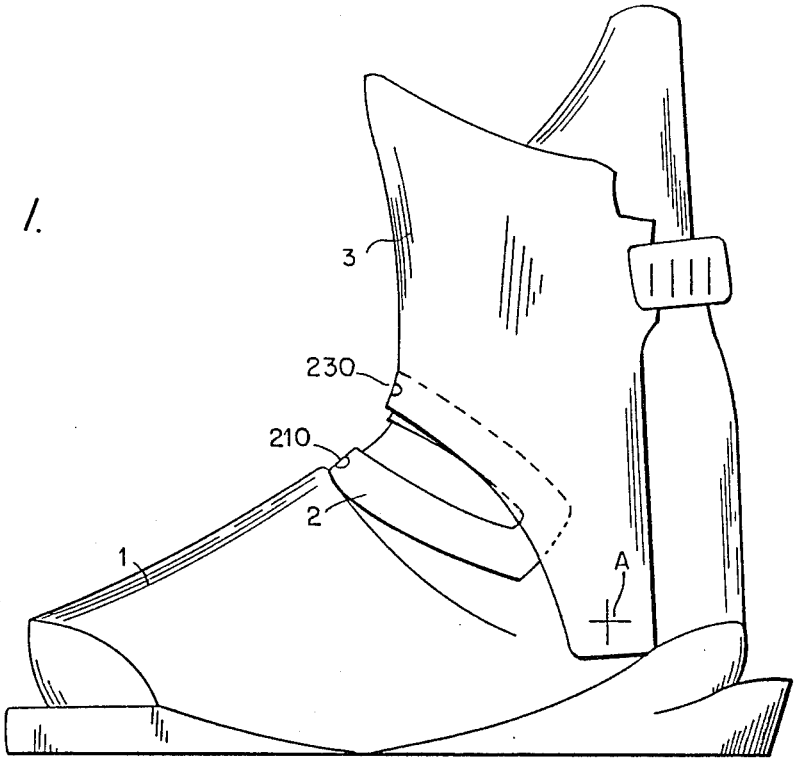
FIG. 1 schematically and generally demonstrates a ski boot modified according to the invention.

FIG. 1 illustrates a schematic representation of a ski boot in which the apparatus of the invention may be used. In a conventional manner, the ski boot comprises a rigid shell base 1 on which a cuff 3 is journalled around a transverse axis. The boot further comprises a rear spoiler and a closure apparatus which closes around the lower leg and which is not identified by numeral. Apparatus 2 which will be described in further detail below is interposed on the instep of the boot between shell base 1 and cuff 3. The apparatus of the invention can, if desired, be made distinct from either and/or both of shell base 1 or cuff 3. For practical reasons of assembling the boot, one can however provide attachment points 210 and 230 in the median longitudinal plane of the boot; it being understood that these serve no functional purpose according to the invention, but are useful in connection with manufacture of the spring member itself.

In effect, cuff 3 maintains apparatus 2 against the instep of shell base 1 during the displacements because cuff 3 at least partially covers and visually obscures it. It is furthermore possible to provide, particularly for aesthetic reasons, that cuff 3 entirely cover apparatus 2 (not shown) which would then be totally invisible.

The spring member can assume the form shown in FIG. 1 but can also have rounded ends at right angles to the diameter of the fold as is seen in the other Figures. In FIG. 1 the spring member is inserted under a lower edge of cuff 3 and on top of an edge of shell base 1 in a manner so as to surround the instep.

In one embodiment of the apparatus of the invention, spring member 2, shown in its free position, i.e., separated from the boot, in FIGS. 6 and 7, assumes the general form of a ring which is folded partially around one of its diameters. Central portions 12 and 13 (FIGS. 6 and 7) are located at right angles to the longitudinal median plane of the boot such that ring 2, under the frontward flexional force of a cuff 3, acts as a spring, either in traction, e.g., if the support edges are positioned within the dihedral of the ring fold (FIG. 3); or in compression, e.g., FIG. 1 wherein the support edges are outside of the ring dihedral.

Figure 3:
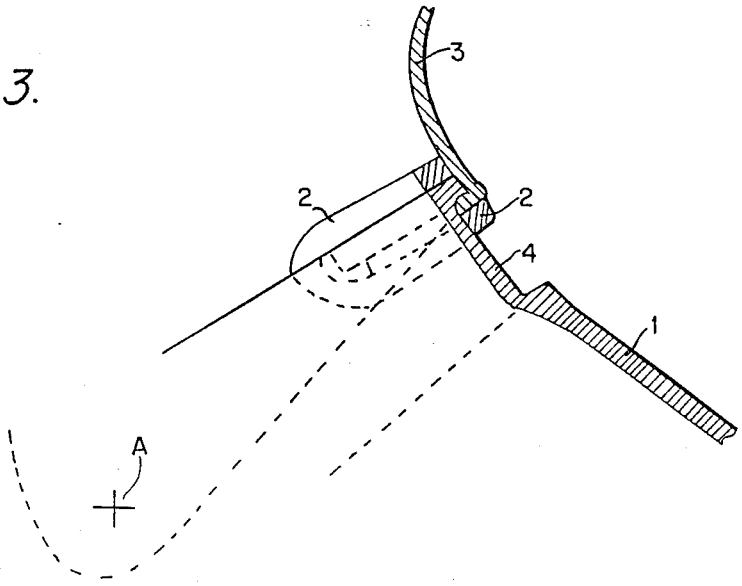
FIG. 3 is a partial longitudinal cross sectional view illustrating the embodiment of FIG. 2 assembled.
Figure 2:
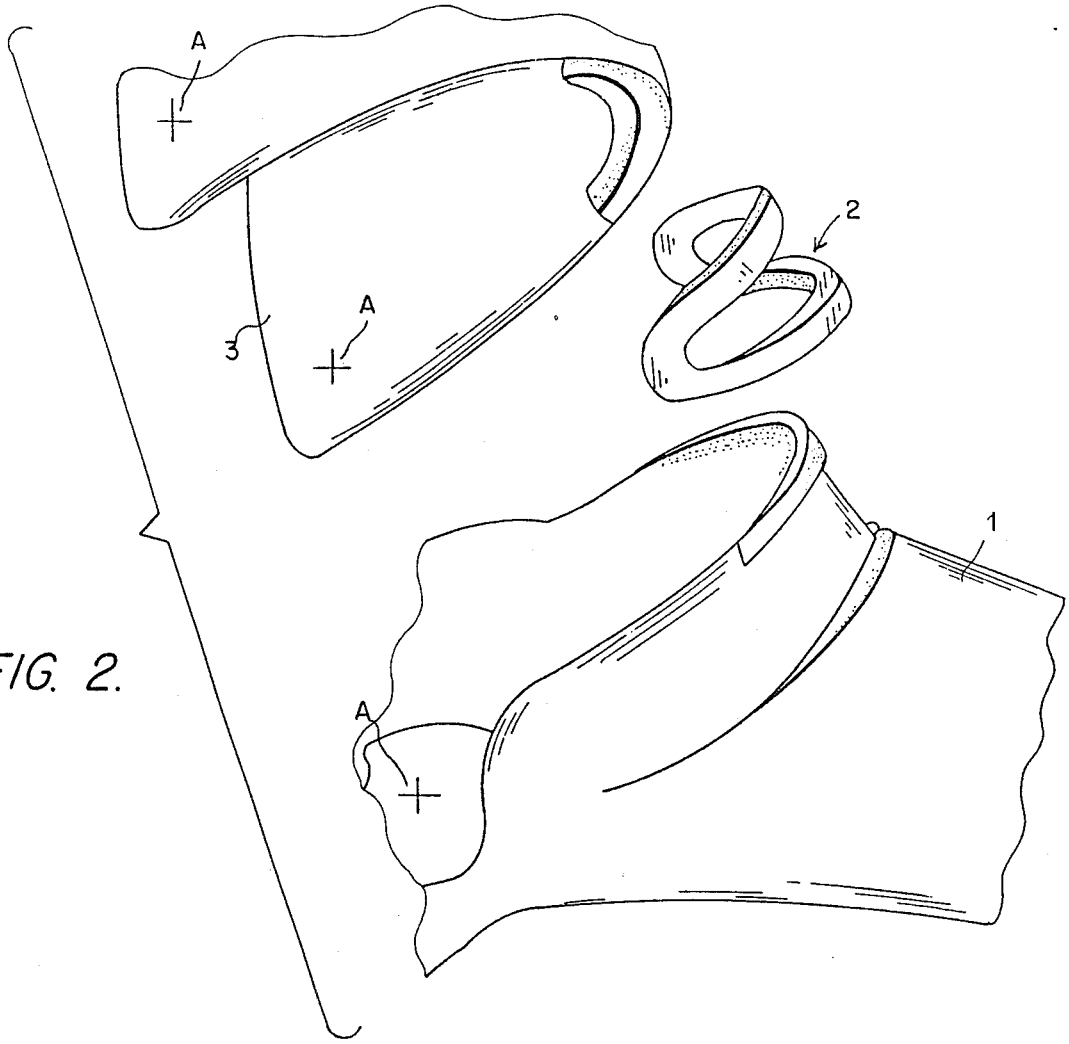
FIG. 2 is an exploded view illustrating a variation of the embodiment of FIG. 1.
Figure 4:
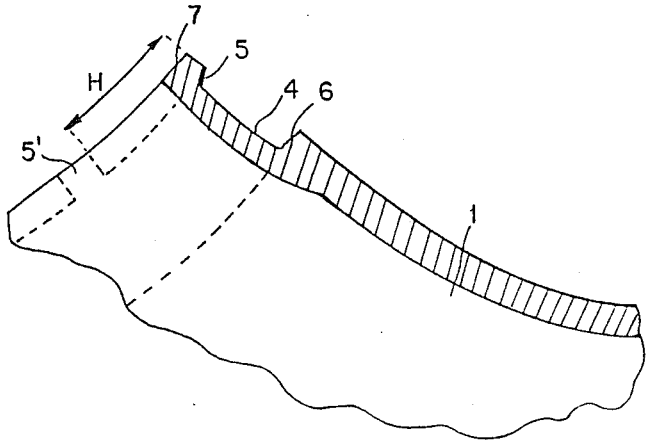

One embodiment is shown in FIGS. 2-5. FIG. 2 illustrates the embodiment, working in tension in an exploded perspective view. Shell base 1, cuff 3, journal axis A, and spring 2 are all shown. FIG. 3 is a partial longitudinal cross section view illustrating the arrangement of the assembled elements, and FIGS. 4 and 5 separately and respectively illustrate in detail the pertinent portions of shell base 1 and cuff 3.

In a manner which is in itself known, cuff 3 is journalled at A on shell base 1 in a manner so as to slide freely or engageably over a ramp 4 provided on shell base 1 in the zone of the instep. Ramp 4 which is approximately concentric to axis A is limited in its upward extent by an upper shell cusp 5 cooperating to provide support as the cuff is moved rearwardly. Cuff cusp 8 has an abutment surface 11 (FIG. 5) on cuff 3 with which cusp 5 cooperates. Ramp 4 is likewise limited in its downward extent by a lower shell cusp 6 which may be formed by a cutout in the wall of shell base 1. This cusp serves as a front stop for the forward displacements of cuff 3. The cusps could, of course, be applied or be integral with the cuff or shell as desired. Upper shell cusp 5 is preferably limited in length (which corresponds to the side length H of FIG. 4). It can alternatively be unlmited in length but must then have a groove 5' (FIG. 4) positioned so as to allow for spring member 2 to pass therethrough when forming its fold.

Upper shell cusp 5 on which a central internal portion 12 of spring 2 rests can be embedded or have attachment means such as attachment point 210 of FIG. 1. Such attachment points can even be used to secure the spring if this is desired.

Cuff 3 has a lower cusp 8 which is again limited in length or grooved so to allow for the passage of spring 2, as has been previously explained with respect to upper shell cusp 5 of shell base 1. Internal abutment surface 9 of lower cusp 8 is normally in contact with upper shell cusp 5 of shell base 1. Intermediate abutment surface 10 slides freely or engageably over ramp 4 during flexional displacements of cuff 3. Terminal abutment surface 11 abuts a second central portion 13 of spring 2.

This displacements due to the flexion of cuff 3 will bias spring 2 by spacing central portions 12 and 13. Spring 2 will thus function as a conventional traction spring and tend to pull cuff 3 back towards its upright position corresponding to the rear support position shown in FIG. 3.

FIGS. 6 and 7 illustrate spring 2 in longitudinal cross section and in perspective in the freed position. These Figures illustrate the different portions cooperating with the elements which have just been described. Central internal portion 12 is biased against shell 1 over terminal abutment surface 7 of upper shell cusp 5. Central portion 13 is in contact with terminal abutment surface 11 of lower cusp 8 of cuff 3, and internal surface 14 adjacent to central portion 13 cooperates with, and slides against ramp 4 of shell base 1. These two surfaces slide against one another during flexional displacements of cuff 3.

Spring member 2, under the effect of flexional forces of cuff 3 is thus biased in a direction corresponding to a spacing of its two central portions 12 and 13 so as to form a dihedral therebetween. It thus operates as a traction spring which stores the forces exerted and then returns cuff 3 into the rear-support position.

Spring member 2 may be formed of a plastic material selected as a function of the mechanical characteristics which one desires to impart. The material may be one which may be different from that of the cuff, and may preferably be a less sophisticated and simpler material which is thus less costly. If desired however the material of the spring member may be specially selected such that it is more sophisticated, e.g., laminated, etc. so as to possess particularly desirable properties in which case it may be more expensive than the material forming the shell and cuff. This is possible as long as spring member 2 is actually an element distinct from cuff 3 and shell base 1.

Other embodiments where this is not the case are described below, an essential aspect being that spring 2 is positioned with respect to shell base 1 as far as possible from transverse journal axis A such that at an equal developed energy, the local force applied on the spring member is as reduced as possible while obtaining the technical effect desired in an optimal manner. With this aim in mind it is likewise desirable that the terminal abutment surfaces 7 of shell base 1 and 11 of the cuff be sufficiently larger such that even for reduced forces their force distribution over the support surfaces is maximal. It will then be possible, as was been stated above, to utilize materials having mechanical characteristics which are not necessarily very strong, thus reducing the cost of the material.

FIGS. 8 and 9 illustrate another embodiment of the invention. In this embodiment spring member 2 has the same form as previously described (FIGS. 6 and 7), and is positioned between the lower edge of cuff 3 and shell base 1. Again, cuff 3 is journalled on shell base 1 around a transverse axis (not shown). Spring member 2 is at least partially positioned within a recess on ramp 4 and is held in position on shell base 1 by blockage element 15 positioned in a central position. The action of cuff 3 on spring member 2 occurs by means of two fingers 16 and 16' (FIG. 9) supported by cuff 3 extending into slot 17 of spring member 2 from the sides of the fold diameter of ring 2. Under flexional bias, cuff 3, by means of its intermediate abutment surface 10 slides on ramp 4 of shell base 1 and both fingers 16 and 16' exert a downward force on the portion of spring member 2 adjacent to the fold diameter. Spring member 2 is blocked by blockage element 15 such that spring 2 functions as an embedded beam or cantilever at 15 and is flexed in the direction illustrated by arrow 18. Since spring member 2 is embedded and blocked by blocking member 15, spring member 2 exerts a reaction force on cuff 3 through fingers 16 and 16' tending to move the cuff back to the upright position.

Figure 10:
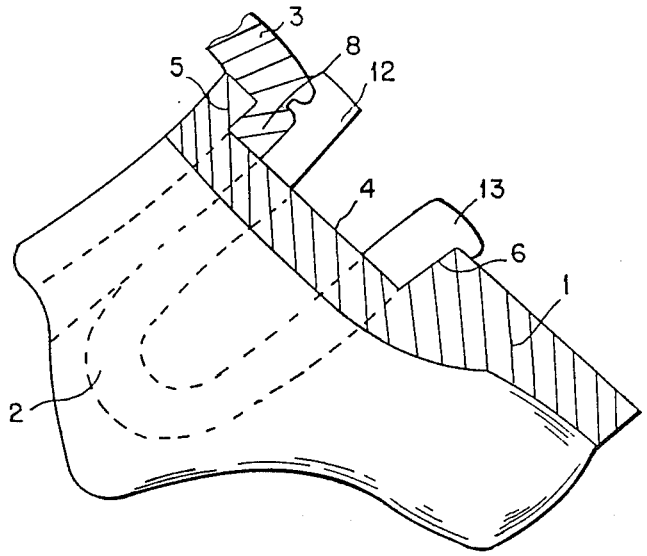
FIG. 10 illustrates another embodiment of an apparatus according to the invention with the cuff and shell base being shown in longitudinal cross section.

Another embodiment of the invention which appears preferable involves utilizing a spring member 2 which is made to work in compression. This embodiment corresponds most closely in principle to the schematic illustration of FIG. 1, previously described. FIG. 10 illustrates an example of this particular arrangement. In this case, spring member 2 still has the same general form as was described above. It is positioned between the lower surface of cuff 3 and a lower shell cusp 6 of shell base 1. Shell base 1 still has ramp 4 and an upper shell cusp 5 which functions as a rear stop for cuff 3. No element is interposed in the space between the two arms 12 and 13 forming a dihedral of spring member 2. As in the preceding case, lower cusp 8 of cuff 3 will slide over ramp 4 of shell base 1 during displacement of cuff 3 during flexion. Having done this, cusp 8 will push central portion 12 of spring member 2 in the direction of central portion 13. In this embodiment, spring 2 thus functions as a compression spring which opposes frontwards flexional movements of cuff 3 and tends to push it back to the rear position. For practical assembly reasons, and for reasons of correct reciprocal positioning, cusps 6 and 8, and corresponding central portions 12 and 13 of spring 2 may be configured so as to mate and may have complementary configurations for this purpose.

Figure 11:
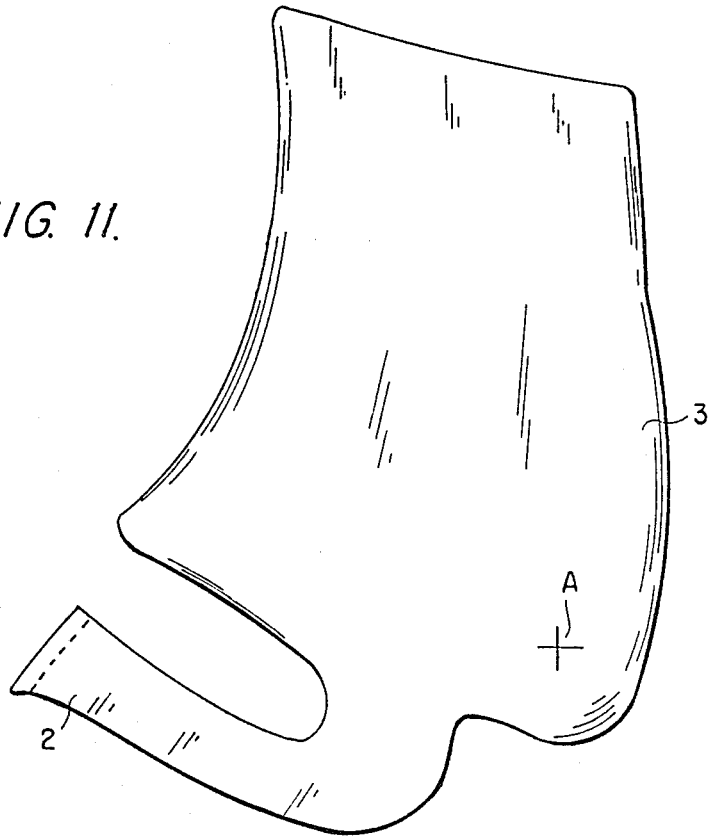
FIG. 11 illustrates yet another embodiment of the invention wherein the spring member of the invention is integral with the cuff.

Another embodiment which follows directly from the preceding is illustrated in FIG. 11. In this case, spring member 2, while still serving the same role as previously, is in the form of a semi-ring, and is integral with cuff 3 (shown alone). As shown, spring member 2 is integral at the ends of its diameter with the cuff. Other configurations following from the preceding will be evident to one of ordinary skill in the art. Only one lower arm of the spring remains which is connected on both sides of the instep of cuff 3, but well in front of journal axis A for the reasons described above. Spring member 2 formed by this arm surrounds the instep, and together with the portion of cuff 3 situated immediately above, acts as in the preceding case in compression.

Quite obviously by arranging the various elements in the manner of the embodiment of FIG. 3, the embodiment of FIG. 11 can likewise be made to function in traction if this is desired.

When spring member 2 is made integral with cuff 3, this obviously does not allow for utilization of different materials as between the spring and the cuff. Thus, it would be appropriate to utilize this embodiment in "more technical" boots which utilize sophisticated and specially selected materials wherein cost is less of a factor in material selection than might normally be the case.

From the preceding description, it is clear that with respect to the known state of the art, the invention has numerous advantages. Spring member 2 is much better integrated with the envelope of the boot than with presently utilized apparatus. The design of the boot is, as a result, considerably simplified. Since the support zones on the cooperating portions have a tendency to increase their abutment surface as the force increases, this much improves the shock absorption of the boot, and thus increases the comfort of the skier, and allows for the utilization of less costly materials.

The separation between the front support and return functions which occurs makes it possible to have a "soft cuff" which is thus very comfortable in support, while nevertheless providing for high spring rigidity and return when the upper is flexed. This allows for a very substantial return function. These advantages are made possible by using a maximum spacing of the spring apparatus with respect to the journal axis of the cuff on the shell base.

Furthermore, in those embodiments in which the spring is made distinct of both the cuff and shell base, materials having different characteristics and properties may be used for the spring member which results in added economy. Such embodiments also permit interchangeability of the spring member to allow for using spring members having different rigidities.

Until this point the spring member has been characterized as a spring 2 formed of a ring folded around a diameter. It is quite obvious that the intention has been to generally describe a configuration and not necessarily be limited to the particular design features of spring 2.

Thus, spring member 2 could in one alternative embodiment be formed to resemble the configuration shown in FIG. 1 so as to have two strips which envelope the instep, integral at their ends and spaced apart. In such a configuration spring member 2 could be formed directly by using molded plastic material, rather than a folded metal or plastic loop, for example. What is important however is that the spring member function in a manner similar to that of FIG. 1 even if its actual appearance is somewhat altered, or if the spring member is formed using a different technique.

Furthermore, although reference has been made to a "folded" ring, it is to be understood that such a configuration could be achieved by molding, and that the manner by which the ring is formed is not significant.

Although the invention has been described with reference to particular means, materials and embodiments, it is to be understood that the invention is not limited to the particulars disclosed and extends to all equivalents within the scope of the claims.

We claim:

1. A ski boot comprising a rigid shell base and a cuff journalled thereto, said cuff having a lower edge which is adapted to cooperate with an upper surface of said shell base via at least one flexion element, said flexion element being mounted transversely to a longitudinal axis of said boot and being adapted to extend over at least a portion of the periphery of the foot of a skier using said boot over a zone extending along the flexion fold of the instep of the skier, wherein said flexion element is in continuous supporting contact with said lower cuff edge at least along the longitudinal axis of said boot.

2. A ski boot formed in accordance with claim 1 wherein said flexion element is integrally formed with said lower cuff edge.

3. A ski boot formed in accordance with claim 1 wherein said flexion element and said cuff are separate members, said flexion element being detachably connected to shell base.

4. A ski boot formed in accordance with claim 1 wherein said flexion element comprises means for maintaining substantially linear contact with said lower edge of said cuff.

5. A ski boot formed in accordance with claim 1 wherein said flexion element comprises means for maintaining substantially punctual contact with said lower cuff edge.

6. A ski boot formed in accordance with claim 1 wherein said flexion element has first and second free ends which are positioned between said shell base and respective guidance edges positioned along both sides of said boot.

7. A ski boot formed in accordance with claim 1 wherein said flexion element comprises a central slot located between an upper active arm which is adapted to abut said lower cuff edge and a lower arm which rests on said shell base.

8. A ski boot formed in accordance with claim 1 wherein said flexion element is integrally formed with said cuff.

9. A ski boot comprising a rigid shell base and a cuff journalled to an upper surface of said shell base, said cuff having a lower edge, said ski boot further comprising at least one flexion element which is mounted on an upper surface of said shell base and which comprises means for continuously supporting said lower edge of said cuff at least at a point along the longitudinal axis of said ski boot.

10. A ski boot formed in accordance with claim 9 wherein said flexion element has an upper edge which is in continuous contact with said lower cuff edge.

11. A ski boot formed in accordance with claim 9 wherein said flexion element is substantially arcuate, has first and second ends which are attached to said shell base, and is adapted to fit over the boot substantially along the instep of a skier.

12. A ski boot formed in accordance with claim 9 wherein said flexion element has first and second ends and is attached to said shell base by fastening means only at said two ends.

13. A ski boot formed in accordance with claim 9 wherein said flexion element is substantially planar and has a first end and a second end attached to said shell base, said substantially planar flexion element having an upper surface which is in substantially continuous line contact with said lower cuff edge.

14. A flexion element which is adapted to be attached to the shell base of a ski boot and which has an upper surface which is adapted to continuously contact a lower edge of a cuff which is pivotally attached to said ski boot, said flexion element comprising first and second free ends, an upper arm, and a lower arm, said upper and lower arms being integrally attached to each other at said first and second ends, said upper and lower arms being separated by an elongated slot.

15. A flexion element in accordance with claim 14 wherein said slot has a central portion with a width which is greater than the width of the remaining portions of said slot.

* * * * *